US007030579B1

(12) United States Patent
Schmitz et al.

(10) Patent No.: US 7,030,579 B1
(45) Date of Patent: Apr. 18, 2006

(54) SYSTEM AND METHOD FOR RETROFIT MECHANISM FOR MOTORIZING A MANUAL TURRET

(75) Inventors: John J. Schmitz, Saint Clair Shores, MI (US); Paul A. Petrovich, Fowlerville, MI (US); A. David Stormer, Clinton Twp., MI (US); Robert G. Washburn, Sterling Heights, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/151,190

(22) Filed: May 31, 2005

(51) Int. Cl.
*H02P 1/00* (2006.01)

(52) U.S. Cl. ..... 318/139; 318/587; 318/591; 89/40.03; 89/41.02

(58) Field of Classification Search ..... 318/139, 318/580, 587, 591; 89/37.13, 40.03, 40.04, 89/41.02
See application file for complete search history.

(56) References Cited

U.S. PATENT DOCUMENTS

| | | | | |
|---|---|---|---|---|
| 2,411,114 | A | | 11/1946 | Rice et al. |
| 2,437,646 | A | * | 3/1948 | Matulaitis et al. ..... 318/367 |
| 2,465,937 | A | | 3/1949 | Sheleski |
| 2,594,198 | A | | 4/1952 | Motley |
| 2,685,233 | A | | 8/1954 | Rose |
| 2,978,961 | A | | 4/1961 | Warren |
| 3,429,222 | A | * | 2/1969 | Flannery et al. ..... 89/41.02 |
| 4,527,458 | A | | 7/1985 | Johnson |
| 4,579,036 | A | * | 4/1986 | LeBlanc ..... 89/41.12 |
| 4,686,888 | A | * | 8/1987 | Sanborn et al. ..... 89/37.13 |
| 4,867,037 | A | | 9/1989 | Smith |
| 5,263,396 | A | * | 11/1993 | Ladan et al. ..... 89/1.11 |
| 5,347,910 | A | * | 9/1994 | Avila et al. ..... 89/41.22 |
| 5,353,680 | A | | 10/1994 | Tiomkin et al. |
| 5,715,902 | A | | 2/1998 | Petrovich et al. |
| 5,949,015 | A | | 9/1999 | Smith et al. |
| 6,101,917 | A | | 8/2000 | Klatte et al. |
| 6,199,469 | B1 | | 3/2001 | Nystrom |
| 6,717,312 | B1 | | 4/2004 | Kaplan et al. |

* cited by examiner

*Primary Examiner*—Rina Duda
(74) *Attorney, Agent, or Firm*—David L. Kuhn; Luis Miguel Acosta; Thomas W. Saur

(57) ABSTRACT

A mechanism for retrofitting a turret that has a manual rotation system with a motorized turret rotation system includes a gear box mechanically coupled to the turret, an electrically powered prime mover unit mechanically coupled to the gear box, a user operated control device electrically coupled to the prime mover unit, and an electrical power supply electrically coupled to the prime mover unit. The turret rotates relative to a body structure. The gear box and the prime mover unit are mounted to the body structure. The control device and the electrical power supply are positioned on the turret. The power supply provides electrical power to the prime mover. The control device presents a control signal to the prime mover when the user actuates the control device, and the turret rotates in response to the control signal.

18 Claims, 2 Drawing Sheets

SYSTEM AND METHOD FOR RETROFIT MECHANISM FOR MOTORIZING A MANUAL TURRET

GOVERNMENT INTEREST

The invention described here may be made, used and licensed by and for the U.S. Government for governmental purposes without paying royalty to us.

BACKGROUND OF THE INVENTION

1. Field of the Invention

The present invention generally relates to a system and method for a retrofit mechanism for motorizing a manual turret.

2. Background Art

Many military vehicle vehicles (e.g., an M-1114 High Mobility Multipurpose Wheeled Vehicle, HMMWV) have a turret assembly mounted on a relatively stationary section (e.g., vehicle body). Such turret mechanisms often include weaponry (e.g., machine guns, rocket launchers, and the like), boom assemblies, audio equipment, nozzles, etc. as well as such assemblies as attack protective equipment, weather protective equipment, operation devices, etc. The turret assembly on many of such vehicles is normally manually slewed (i.e., traversed, rotated, moved about a normally vertical axis, laterally aimed, rotationally positioned side-to-side, moved clockwise or counterclockwise, etc.). Similarly, turret mechanisms can be mounted and manually slewed in connection with non-vehicle (e.g., watercraft, land-based installations, aircraft, etc.) implementations.

When the weight of the turret mechanism is increased (e.g., when additional equipment is added to the devices already on the turret assembly) beyond certain limits, the manual slewing operation of the turret becomes too difficult for a person of normal stature (e.g., a person in a $50^{th}$ percentile) to accomplish in a practical manner. For example, when a M1114 HMMWV turret having a weapon, gun shield and ammunition is equipped with a gunner protection kit (GPK), the combined weight is over 550 lbs.

One conventional approach to improving the ability of a person having a normal stature to manipulate (slew) a massive turret assembly (i.e., a turret assembly having weight beyond typical human limits to slew without aid) is to provide mechanical assistance (e.g., a hand crank with gear reduction to provide a mechanical advantage) to the turret assembly.

Without the hand crank assembly assistance, and sometimes due to high stresses involved, overcompensation (e.g., slewing past a desired target zone) and operator fatigue can, at the extreme, lead to slewing the turret out of control. Such a situation is obviously hazardous when, for example, the operator is attempting to maneuver a turret mounted weapon into firing position, especially when the vehicle where the turret is installed is on an incline that adds additional gravitational forces that must overcome.

However, even implementation of a hand crank assembly has deficiencies in that for proper ergonometric considerations, the gear reduction is such that the hand crank can be operated by a $5^{th}$ percentile female soldier which generally slows the slewing operation considerably, the hand crank assembly is incorporated in connection with a hand brake which must be released before the turret can be slewed and reset after the turret is slewed which also slows the slewing operation as well as causing a distraction, the hand crank assembly adversely encroaches on a $95^{th}$ percentile male gunner envelope thus causing a reduction in space and mobility for such a gunner, and the crank assembly protrudes such that the gunner or equipment can bump or snag on the crank assembly.

As such, another approach to slewing a massive turret assembly is to provide motorized assistance under the control of an operator (e.g., the gunner). The motorized assistance is often implemented via an electrical motor (and gear box) assembly. However, conventional turret mounted electrical motors are typically implemented having electrical energy provided from the body of the vehicle upon which the turret is mounted.

Conventional approaches for providing electrical energy to and from electrical devices (e.g., motors, batteries, motorized pumps, capacitors, etc.) that are installed on rotating turrets often include slip ring or multi-geared ring and contactor assemblies. However, such assemblies are generally expensive (costly), prone to increase electrical path resistance and loss of electrical continuity due to damage and corrosion, require area on the turret and mount when the amount of desired area may already be limited, require extensive modification to a structure such as the turret and the turret mounting that was not initially designed for a motorized assembly, etc.

Another conventional approach for providing electrical energy to and from electrical devices that are installed on rotating turrets is to directly electrically connect the turret to the relatively stationary section of the vehicle (e.g., electrically hard wire the vehicle body and the turret together via electrical cabling or wiring) and to limit the amount (i.e., angle) of rotation that the turret is permitted to traverse. Such an approach has the deficiency of limiting the useful angular range of the vehicle where the turret is mounted. Such turret rotation angular limitations are generally unacceptable for military vehicles. The conventional slip ring or multi-geared ring and contactor assemblies, and the conventional direct hard wiring approaches may also tax limited vehicle electrical power capacity.

Further, the equipment that is installed on a turret is often positioned primarily at one side of the turret. Such a placement can cause the turret to be unbalanced (i.e., the center of gravity of the turret may be significantly skewed from the axis of rotation of the turret). Conventional approaches to counter-balancing turrets and the like include counter-balance springs, operator seating to use operator weight as a weight offset, and counter-balance ballast material such as cast iron blocks. However, such conventional approaches have deficiencies that include the addition of cost and weight, restriction of operator movement, and reduction of usable space.

Thus, there exists a need and an opportunity for an improved system and method for a retrofit unit for motorizing a manual turret. Such an improved system and method may overcome one or more of the deficiencies of the conventional approaches.

SUMMARY OF THE INVENTION

Accordingly, the present invention may provide an improved system and method for a retrofit motorized turret that may overcome deficiencies of conventional approaches.

According to the present invention, a mechanism for retrofitting a turret that has a manual rotation system with a motorized turret rotation system is provided. The mechanism comprises a gear box mechanically coupled to the turret, an electrically powered prime mover unit mechanically coupled to the gear box, a user operated control device electrically coupled to the prime mover unit, and an electrical power supply electrically coupled to the prime mover unit. The turret rotates relative to a body structure. The gear box and the prime mover unit are mounted to the body structure. The control device and the electrical power supply are positioned on the turret. The power supply provides electrical power to the prime mover. The control device presents a control signal to the prime mover when the user actuates the control device, and the turret rotates in response to the control signal.

Also according to the present invention, a method of retrofitting a turret that has a manual rotation system with a motorized turret rotation system is provided. The method comprises mechanically coupling a gear box to the turret, mechanically coupling an electrically powered prime mover unit to the gear box, electrically coupling a user operated control device to the prime mover unit, and electrically coupling an electrical power supply to the prime mover unit. The turret rotates relative to a body structure. The gear box and the prime mover unit are mounted to the body structure. The control device and the electrical power supply are positioned on the turret. The power supply provides electrical power to the prime mover. The control device presents a control signal to the prime mover when the user actuates the control device, and the turret rotates in response to the control signal.

The above features, and other features and advantages of the present invention are readily apparent from the following detailed descriptions thereof when taken in connection with the accompanying drawings.

DETAILED DESCRIPTION OF THE PREFERRED EMBODIMENT(S)

With reference to the Figures, the preferred embodiments of the present invention will now be described in detail. Generally, the present invention provides an improved mechanism (i.e., system, apparatus, kit, assembly, etc.) and an improved method (i.e., operation, process, steps, procedure, etc.) for a retrofit (i.e., aftermarket, post-typical assembly, etc.) motorized turret. The present invention may be implemented in lieu of an existing manually operated, hand cranked turret rotating assembly. The present invention may be implemented when there is no existing assistance or aid to rotation of the turret assembly.

In one example, the present invention may be advantageously implemented in connection with an M-1114 High Mobility Multipurpose Wheeled Vehicle (HMMWV), turret assembly. However, the present invention may be implemented in connection with any appropriate turret mechanism in vehicle and non-vehicle (e.g., watercraft, land-based installations, aircraft, etc.) implementations to meet the design criteria of a particular application.

In one example of an implementation of the present invention in connection with a HMMWV, existing holes and mounting locations may advantageously be used to eliminate use of additional holes or brackets for installation of the present invention. One of ordinary skill in the art would understand that minor modifications to the present invention, as illustrated, could be made for other particular installations within the scope and spirit of the present invention. For example, appropriate holes may be drilled, appropriate brackets may be made, and appropriate fasteners may be used, etc. to meet the design criteria of a particular application.

The system and method of the present invention may provide for self-energization of the motorized turret via a battery power supply that is generally mounted on the turret substantially (i.e., about, essentially, approximately, nearly, at or close to, etc.) opposite of the normal turret-mounted equipment (e.g., gun, gun mount, gun shield, operator/gunner shield, rocket propelled grenade (RPG) launcher, audio reproduction devices, and the like). The motorized turret retrofit kit of the present invention may provide for variable rate turret slewing, immediate (e.g., substantially instantaneous) turret rotational direction change (i.e., rapid changing from clockwise rotation to counterclockwise rotation or vice versa), and automatic turret position latching (position lock) when the desired turret orientation is reached.

The placement of the turret battery power supply substantially opposite of the normal turret-mounted equipment may provide counter balancing of the normal turret-mounted equipment. As such, the center of gravity of the turret assembly including the present invention may be closer to the axis of rotation for the turret assembly than without the present invention.

Figure 1:
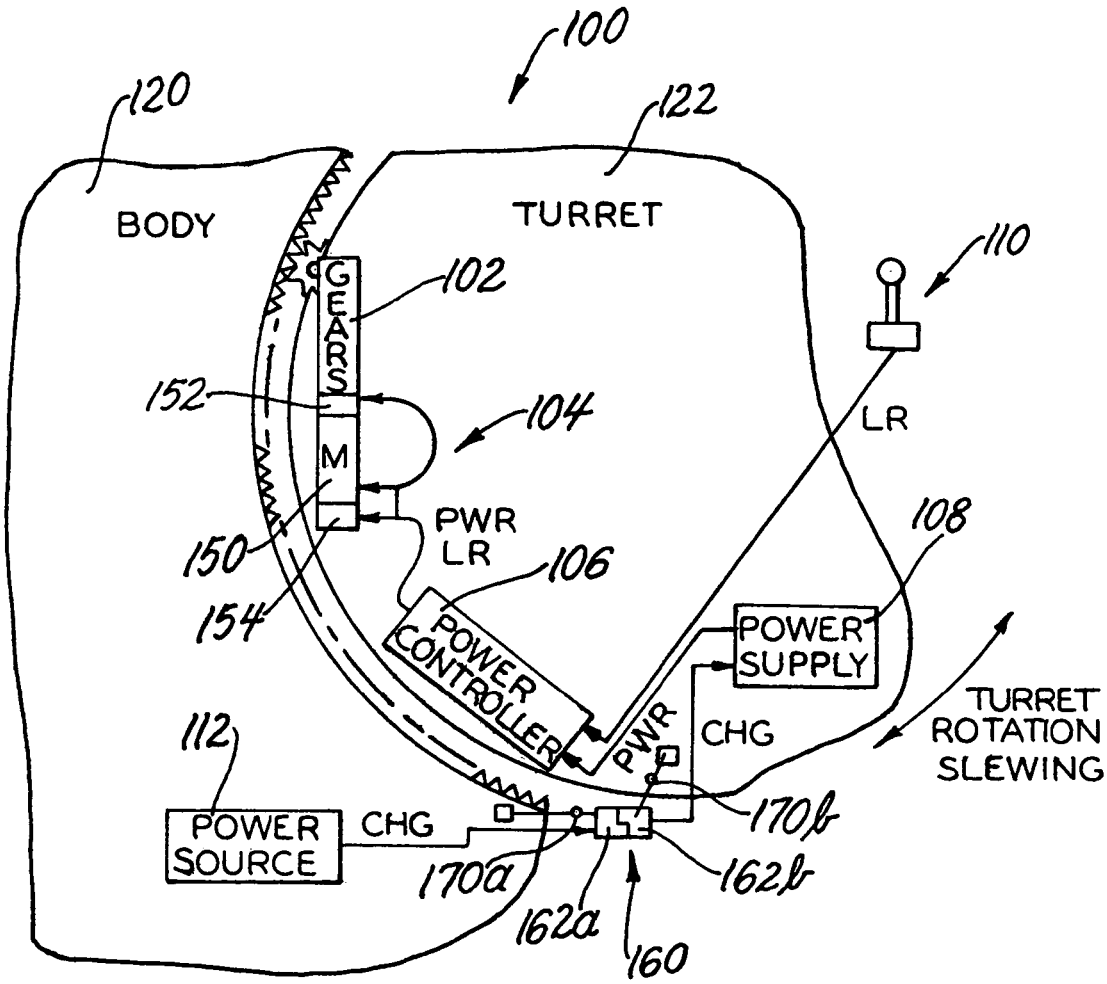
FIG. 1 is a diagram of the present invention as viewed from the underside of a turret in a vehicle.
Figure 2:
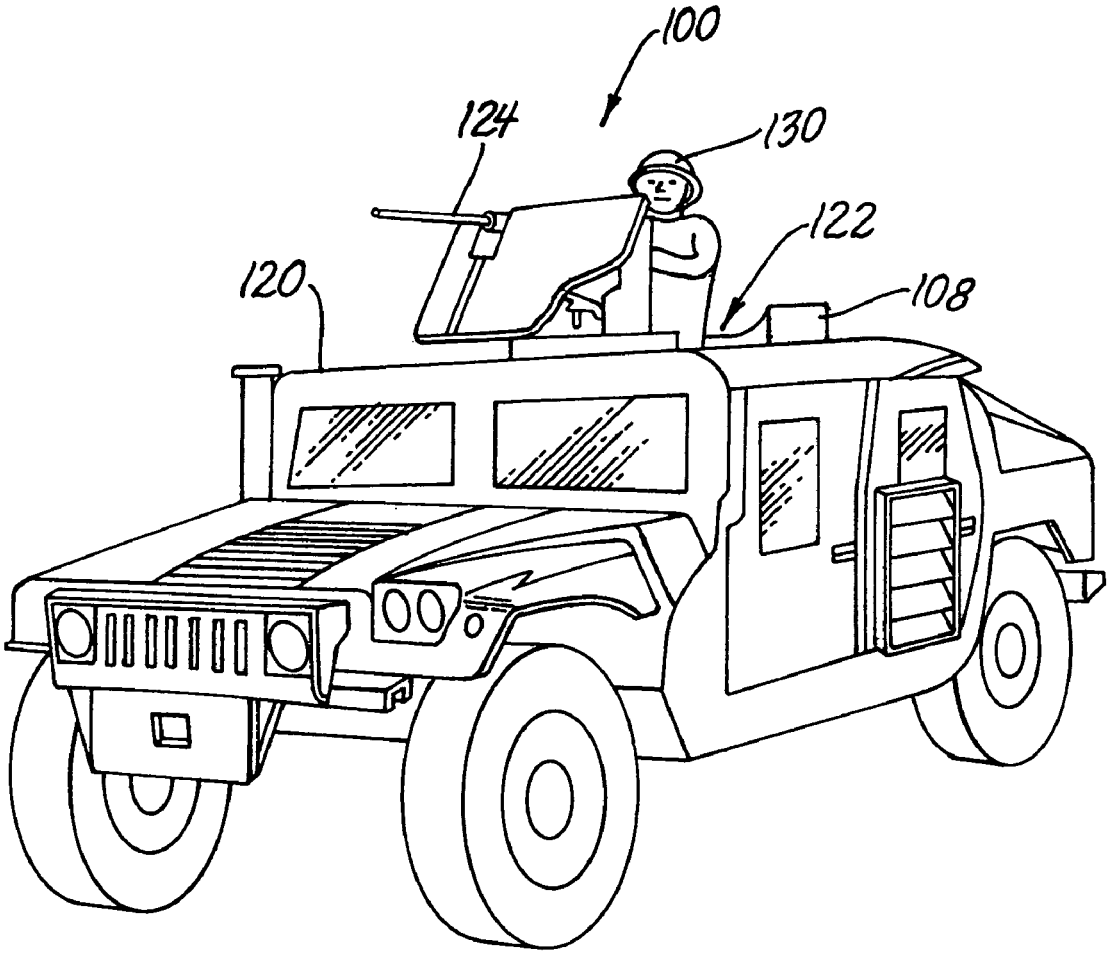
FIG. 2 is a diagram of the present invention in connection with a vehicle.

Referring to FIGS. 1 and 2, in combination, diagrams illustrating a mechanism (i.e., system, kit, assembly, apparatus, etc.) 100 of the present invention are shown. The system 100 generally comprises a gear reduction and drive box (i.e., "gears", unit, subsystem, assembly, apparatus, subassembly, etc.) 102, a prime mover unit (i.e., subassembly, subunit, assembly, apparatus, etc.) 104, a motor controller 106, a power supply 108, a turret control device 110, and an electrical power source 112.

The kit 100 may be implemented in connection with a vehicle (i.e., vehicle body, vehicle frame, etc.) (or other appropriate structure) 120 (shown in FIG. 2) having a rotatable (e.g., slewable, movable about an axis, etc.) turret 122 (shown partially in FIG. 1) mounted thereon and separate therefrom. The turret 122 is generally separate from the body 120 and generally rotates in the body 120. The kit 100 is generally operated by an operator (e.g., user, gunner, technician, soldier, etc.) 130. The operator 130 generally desires to rotate the turret 122 relative to the position of the vehicle body 120 (e.g., track a moving target with a weapon mounted on the turret 122). The operator 130 may operate (actuate) the turret control device 110 to effect the desired rotation of the turret 122.

The gear box 102, the apparatus 104, the motor controller 106, and the power supply 108 are generally mounted on (i.e., reside on, positioned on, etc.) the turret 122. In one example, the gears 102, the apparatus 104, and the motor controller 106 may be mounted (e.g., fastened via bolt fasteners) in an area where a manual crank assembly is conventionally mounted using the same mounting holes as the manual crank assembly. The device 110 generally resides on the turret 122. The user 130 is generally positioned on the turret 122. However, the user 130 is generally free to move about. The power source 112 is generally mounted on the frame 120. As such, the mechanism 100 is generally implemented as a retrofit kit to provide a manually rotated turret with a motorized turret rotating system.

The gear reduction and drive box 102 is generally mechanically coupled to the prime mover unit 104. The motor controller 106 and the power supply 108 are generally electrically coupled to the motor unit 104. The control device 110 is generally electrically coupled to the motor controller 106. The electrical power source 112 is generally electrically coupled to the power supply 108.

The power supply 108 generally supplies (i.e., provides, presents, furnishes, sends, etc.) electrical power (e.g., PWR) to the motor controller 106. The control device 110 generally presents at least one control signal (e.g., LR) to the motor controller 106. The power source 112 generally presents electrical power (e.g., CHG) to the power supply 108. The controller 106 generally presents the electrical power PWR and the control signal LR to the motor apparatus 104.

The apparatus 104 generally comprises a self-contained assembly that includes an electrically powered motor 150, a solenoid operated clutch 152, and a solenoid operated brake 154. The motor 150, clutch 152, and brake 154 are generally selectively, electro-mechanically coupled. The electrical power PWR generally provides power to the apparatus 104 such that the motor 150 operates (i.e., rotates and produces torque), the clutch 152 is engaged, and the brake 154 is disengaged (released) in response to the control signal LR. The clutch 152 may be a normally disengaged (free-turning) mechanism. The brake 154 may be a normally engaged mechanism that may hold the turret 122 at a position.

In one example, the control device 110 may be implemented as a ball head joy stick. In another example, the device 110 may be implemented as a T-bar joy stick. In yet another example, the device 110 may be implemented as a rocker switch. In yet another example, the device 110 may be implemented as a rotating knob switch. However, the device 110 may be implemented as any appropriate control device to meet the design criteria of a particular application.

The control device 110 generally presents the control signal LR in response to actuation (i.e., operation, manipulation, etc.) by the operator 130. The speed of the motor 150 and, thus, speed of rotation of the turret 122 may be controlled via the motor controller 106 by operation of the device 110. In another example (not shown), the controller 106 may be deleted and the device 110 may directly control the operation of the apparatus 104. In one example, the signal LR may be modulated (i.e., controlled) by the amount of movement of at least one element of the device 110 such that modulation of the signal LR controls rotational speed of the motor 150.

For example, when the device 110 is implemented as a joy stick, a small displacement of the joy stick handle relative to the joy stick body may cause a proportionally slow rotational speed of the motor 150, and a large displacement of the joy stick handle relative to the joy stick body may cause a proportionally rapid rotational speed of the motor 150. Similarly, intermediate displacements of the joy stick handle relative to the joy stick body may cause proportionally intermediate rotational speeds of the motor 150.

Thus, the present invention may provide variable rate turret 122 slewing, immediate (e.g., substantially instantaneous) turret rotational direction change (i.e., rapid changing from clockwise rotation to counterclockwise rotation or vice versa), and automatic turret 122 position latching (position lock via the brake 154) when the desired turret orientation is reached. When the mechanism 100 is implemented in connection with a gun turret, the gunner 130 may be able to more accurately track a target than with conventional approaches. Operator fatigue may also be reduced when compared to conventional approaches regardless of the physical size of the user 130.

The control device 110 may include a magnetic base that provides the operator 130 the capability of mounting the device 110 at a convenient location on the turret 122 when the turret 122 is made of a magnetic material such as steel.

The prime mover unit 104 is generally mechanically coupled to the gear box 102 such that the gear box 102 is driven by the motor 150 when the clutch 152 is engaged and the brake 154 is released. The gear box 102 is generally mechanically coupled to the turret 122. Drive teeth on the gears 102 generally mechanically engage matching driven teeth on the turret 122 such that when the clutch 152 is engaged (e.g., in response to the control signal LR), the brake 154 is released (e.g., in response to the control signal LR, in response to a manual release, etc.), and the motor 150 is running (turning) (e.g., in response to the electrical power PWR and the control signal LR), the turret 122 rotates relative to the body 120. The direction of rotation of the turret 122 is generally selected via the motor controller 106 by an operation of the control device 110 (e.g., in response to the control signal LR). However, when the controller 106 is not implemented, the control device 110 may directly control the direction of rotation of the turret 122 via the signal LR.

When the user 130 desires to rotate the turret 122 relative to the frame 120, the user 130 generally actuates the control device 110 and the signal LR is presented to the controller 106. The controller 106 generally presents the control signal LR and the electrical power PWR to the apparatus 104 in response to the signal LR.

The power supply 108 is generally implemented as battery box containing an appropriate number of batteries of a size and electrical capacity predetermined to meet the design criteria of the particular application of the system 100. In one example the size and electrical capacity of the batteries implemented in the power supply 108 may be selected such that when the batteries in the power supply 108 are fully charged, normal use of the system 100 may be performed for a typical patrol cycle without recharging the batteries in the power supply 108 (e.g., to provide for self-energization of the motorized turret during a "silent watch"). However, the power supply may be implemented as any appropriate electrical power storage device (e.g., capacitors, ultra-capacitors, etc.) to meet the design criteria of a particular application.

The power supply 108 may be mounted on the turret 122 substantially opposite other normal turret-mounted equipment 124. Such additional equipment 124 may include a gun, gun mount, gun shield, operator/gunner shield, rocket propelled grenade (RPG) launcher, audio reproduction devices, and the like. As such, the weight of the power supply 108 may provide counter balancing to the weight of the normal turret-mounted equipment 124.

The power source 112 generally comprises an alternator or the like that provides electrical power and energy charging to the vehicle 120 and electrically powered systems thereon (not shown). As such, the electrical power source 112 generally provides electrical energy (i.e., the electrical charging energy current CHG) to the power supply 108.

The electrical power source 112 generally provides the electrical charging energy CHG to the power supply 108 via a cable (i.e., wiring) 160 having a connector assembly 162 (e.g., mating electrical connector halves 162*a* and 162*b*). The connector half 162*a* may be mechanically fastened to the body 120 using a tether 170*a* and the connector half 162*b* may be mechanically fastened to the turret 122 using a tether 170*b*. The tethers 170 are generally sized to respective predetermined lengths to provide tension to the respective connector halves 160 during predetermined modes of operation of the mechanism 100.

The electrical wiring 160 that transmits the electrical charging energy CHG to the power supply 108 via the connector assembly 162 is generally sized to a predetermined length such that the turret 122 may be rotated across a predetermined (usually a typical) operating range (arc of rotation) and the wiring 160 may be positioned to reduce or prevent interference and obstruction of vehicle 120 user (e.g., the user 130) movements and operations.

The connector halves 162*a* and 162*b* generally remain mated during movement of the turret 122 across the normal range of operation such that the charging current CHG is provided to the batteries in the power supply 108. However, the user 130 may desire to move the turret 122 past the predetermined operating range. When the operator 130 moves the turret 122 past the predetermined operating range, tension may be applied to the tethers 170 such that the connector halves 162*a* and 162*b* separate without damage to the electrical cable 160. The power supply 108 generally contains sufficient stored energy to operate the motor 150 for a duration within the predetermined typical self-energization time (e.g., a typical patrol cycle).

When the turret 122 is returned to the normal operating range, the connector 162 may be mated and the charging current CHG may supply energy to the power supply 108.

When the power supply 108 is unable to proved sufficient energy to operate the motor 150 (e.g., energy stored in the power supply 108 becomes depleted, the batteries in the power supply 108 are damaged, and the like), the motor 150 fails, etc., the clutch 152 may be manually disengaged such that the turret 122 may be manually rotated (i.e., the turret 122 may "free wheel").

As is apparent then from the above detailed description, the present invention may provide an improved system and an improved method for a mechanism for retrofitting a manually rotated turret with a motorized turret rotating system that overcomes deficiencies of conventional approaches. The present invention may provide speed of rotation of a turret that is independent of operator physical stature (e.g., independent of operator percentile).

The prime mover unit 104 may include an integral brake (i.e., the brake 154) that is generally engaged (i.e., in a failsafe mode to hold the turret 122 in place) except when the operator (i.e., the user 130) initiates a slew command (i.e., actuates the control device 110 such that the control signal RL is presented). The clutch 152 generally provides a disengagement point in the mechanism 100 in case of failure of the motor 150, the power supply 108, and the like.

The system 100 does not appreciably extend (protrude) into the area typically occupied and used by the user 130 (e.g., a gunner). As such, the amount of room for the user 130 is generally maximized. When the system 100 is implemented with variable speed control for the turret rotation, the user (e.g., gunner) may be able to more accurately track and fire upon targets than when conventional approaches such as manual turret movement or manual crank mechanisms are used. User distractions may be minimized and firing time may be optimized by implementation of the mechanism 100. The motor 150 may be powered for continued use throughout a patrol cycle even when full turret rotation is enabled (i.e., when the charging cable 160 is disconnected at the connector 162). When the wiring 160 is connected, the power source 112 generally maintains charging (e.g., presents the charging current CHG) to the power supply 108.

Various alterations and modifications will become apparent to those skilled in the art without departing from the scope and spirit of this invention and it is understood this invention is limited only by the following claims.

The invention claimed is:

1. A mechanism for retrofitting a turret that has a manual rotation system with a motorized turret rotation system, the mechanism comprising:

a gear box mechanically coupled to the turret;

an electrically powered prime mover unit mechanically coupled to the gear box;

a user operated control device electrically coupled to the prime mover unit;

an electrical power supply electrically coupled to the prime mover unit, wherein the turret rotates relative to a body structure, the gear box and the prime mover unit are mounted to the body structure, the control device and the electrical power supply are positioned on the turret, the power supply provides electrical power to the prime mover, the control device presents a control signal to the prime mover when the user actuates the control device, and the turret rotates in response to the control signal; and an electrical power source that is positioned on the body and electrically coupled to the power supply via mating electrical connector halves that are disengagable in response to a predetermined tension force, a first tether connected to a first respective half of the connector halves and the body and a second tether connected to a second respective half of the connector halves and the turret, wherein the electrical power source provides a charging current to the power supply, and the tethers are sized such that when the turret is rotated beyond a predetermined range, the tethers provide a tension force that exceeds the predetermined tension force.

2. The mechanism of claim 1 wherein the mechanism is implemented as a replacement for the manual rotation system.

3. The mechanism of claim 2 wherein existing holes and mounting locations for the manual rotation system are used to eliminate additional holes or brackets for installation of the mechanism.

4. The mechanism of claim 1 wherein the mechanism is implemented in connection with an M-1114 High Mobility Multipurpose Wheeled Vehicle (HMMWV) turret assembly.

5. The mechanism of claim 1 further comprising a motor controller mounted to the turret and electrically coupled to the control device, the power supply, and the prime mover unit, wherein the control device presents the control signal to the controller, the controller presents the control signal to the prime mover and the electrical power to the prime mover in response to the control signal, the electrical power is presented to the prime mover in proportion to an amount of actuation of the control device, and the turret rotates at a speed that is proportional to the electrical power.

6. The mechanism of claim 1 wherein the prime mover unit comprises a brake, an electric motor, and a clutch all of which receive the electrical power and the control signal, and during a normal mode of operation, the brake is disengaged, the motor rotates, and the clutch is engaged in response to the electrical power and the control.

7. The mechanism of claim 6 wherein the clutch is manually disengagable when the prime mover is non-functional to provide manual rotation of the turret.

8. The mechanism of claim 1 wherein the power supply is positioned on the turret substantially opposite additional equipment that is mounted on the turret to provide counter balancing to the additional equipment.

9. The mechanism of claim 1 wherein the power supply comprises at least one battery having a full charge capacity sufficient to operate the turret during a predetermined patrol cycle without being recharged.

10. A method of retrofitting a turret that has a manual rotation system with a motorized turret rotation system, the method comprising:

mechanically coupling a gear box to the turret;

mechanically coupling an electrically powered prime mover unit to the gear box;

electrically coupling a user operated control device to the prime mover unit;

electrically coupling an electrical power supply to the prime mover unit, wherein the turret rotates relative to a body structure, the gear box and the prime mover unit are mounted to the body structure, the control device and the electrical power supply are positioned on the turret, the power supply provides electrical power to the prime mover, the control device presents a control signal to the prime mover when the user actuates the control device, and the turret rotates in response to the control signal; and positioning an electrical power source on the body and electrically coupling the electrical power source to the power supply via mating electrical connector halves that are disengagable in response to a predetermined tension force, connecting a first tether to a first respective half of the connector halves and the body and a second tether to a second respective half of the connector halves and the turret wherein the electrical power source provides a charging current to the power supply, and the tethers are sized such that when the turret is rotated beyond a predetermined range, the tethers provide a tension force that exceeds the predetermined tension force.

11. The method of claim 10 wherein the mechanism is implemented as a replacement for the manual rotation system.

12. The method of claim 11 wherein existing holes and mounting locations for the manual rotation system are used to eliminate additional holes or brackets for installation of the mechanism.

13. The method of claim 10 wherein the method is implemented in connection with an M-1114 High Mobility Multipurpose Wheeled Vehicle (HMMWV) turret assembly.

14. The method of claim 10 further comprising mounting a motor controller to the turret and electrically coupling the motor controller to the control device, the power supply, and the prime mover unit, wherein the control device presents the control signal to the controller, the controller presents the control signal to the prime mover and the electrical power to the prime mover in response to the control signal, the electrical power is presented to the prime mover in proportion to an amount of actuation of the control device, and the turret rotates at a speed that is proportional to the electrical power.

15. The method of claim 10 wherein the prime mover unit comprises a brake, an electric motor, and a clutch all of which receive the electrical power and the control signal, and during a normal mode of operation, the brake is disengaged, the motor rotates, and the clutch is engaged in response to the electrical power and the control.

16. The method of claim 15 wherein the clutch is manually disengagable when the prime mover is non-functional to provide manual rotation of the turret.

17. The method of claim 10 wherein the power supply is positioned on the turret substantially opposite additional equipment that is mounted on the turret to provide counter balancing to the additional equipment.

18. The method of claim 10 wherein the power supply comprises at least one battery having a full charge capacity sufficient to operate the turret during a predetermined patrol cycle without being recharged.

* * * * *